US005314189A

United States Patent [19]

Kerivan

[11] Patent Number: 5,314,189

[45] Date of Patent: May 24, 1994

[54] MODERN CHESS SET USING ARCHITECTURAL LANGUAGE TO SHAPE PLAYABLE PIECES

[76] Inventor: David W. Kerivan, 12 W. Read St., Baltimore, Md. 21201

[21] Appl. No.: 881,654

[22] Filed: May 12, 1992

[51] Int. Cl.[5] ..... A63F 3/02

[52] U.S. Cl. ..... 273/260; 273/288; 273/290

[58] Field of Search ..... 273/241, 242, 260, 261, 273/288, 290

[56] References Cited

U.S. PATENT DOCUMENTS

| | | | |
|---|---|---|---|
| D. 170,489 | 9/1953 | Wright | 273/288 X |
| D. 207,323 | 4/1967 | Hanna et al. | 273/288 X |
| 1,628,412 | 5/1927 | Lesavoy | 273/288 |
| 3,608,904 | 9/1971 | Margetson | 273/288 |
| 3,627,324 | 12/1971 | Krepp | 273/260 |
| 3,677,550 | 7/1972 | Mathers | 273/288 |
| 3,856,309 | 12/1974 | Helfgott | 273/288 |
| 3,947,040 | 3/1976 | Samuels | 273/288 |
| 4,095,801 | 6/1978 | Kembar | 273/260 |
| 4,249,740 | 2/1981 | Cheney et al. | 273/288 X |

FOREIGN PATENT DOCUMENTS

| | | | |
|---|---|---|---|
| 0677949 | 7/1939 | Fed. Rep. of Germany | 273/290 |
| 3611513 | 10/1987 | Fed. Rep. of Germany | 273/290 |
| 2308392 | 11/1976 | France | 273/260 |
| 561556 | 5/1975 | Switzerland | 273/290 |
| 15213 | of 1901 | United Kingdom | 273/260 |
| 558461 | 1/1944 | United Kingdom | 273/288 |

OTHER PUBLICATIONS

"Chess Nuts Set", *Hanover House Catalog,* Aug. 16, 1971, p. 55.

"How to Play Chess While Playing It", *Popular Mechanics,* Aug. 1976, p. 71.

*Primary Examiner*—William E. Stoll

*Attorney, Agent, or Firm*—Walter G. Finch

[57] ABSTRACT

A chess set is provided which has a plurality of playable pieces and a dimensional chess board. These pieces consist of, chess men and the pawns each having a structure comprising of channel like lines at the base and a geometric band inscribed on the front of each piece. The geometric bands identify the pieces into groups with matching bands. The channel like lines that extend around all sides of the playable pieces indicate the point value of each chess piece and pawn. The structure of the chess pieces also includes a cavity at the base with an opening that a particular pawn fits exactly inside of identifying a visual relationship between them with the chess piece becoming the parent piece of the pawn. A pawn that reaches the eighth rank becomes a replication of its parent piece with the exception of the king's pawn which can become any piece except another king. The chess pieces have geometrically shaped tops that indicate the movement potential of each piece when it is engaged in play. These shapes are defined as being either a collection of slots or a collection of notches. The slots represent movement of the piece the full length of the chessboard along the ranks, the files, or diagonally. The notches represent limited mobility along the ranks, the files, or diagonally as indicated in the fame rules. The top of each pawn has a longitudinal axis that indicates forward movement when it is positioned for play.

11 Claims, 11 Drawing Sheets

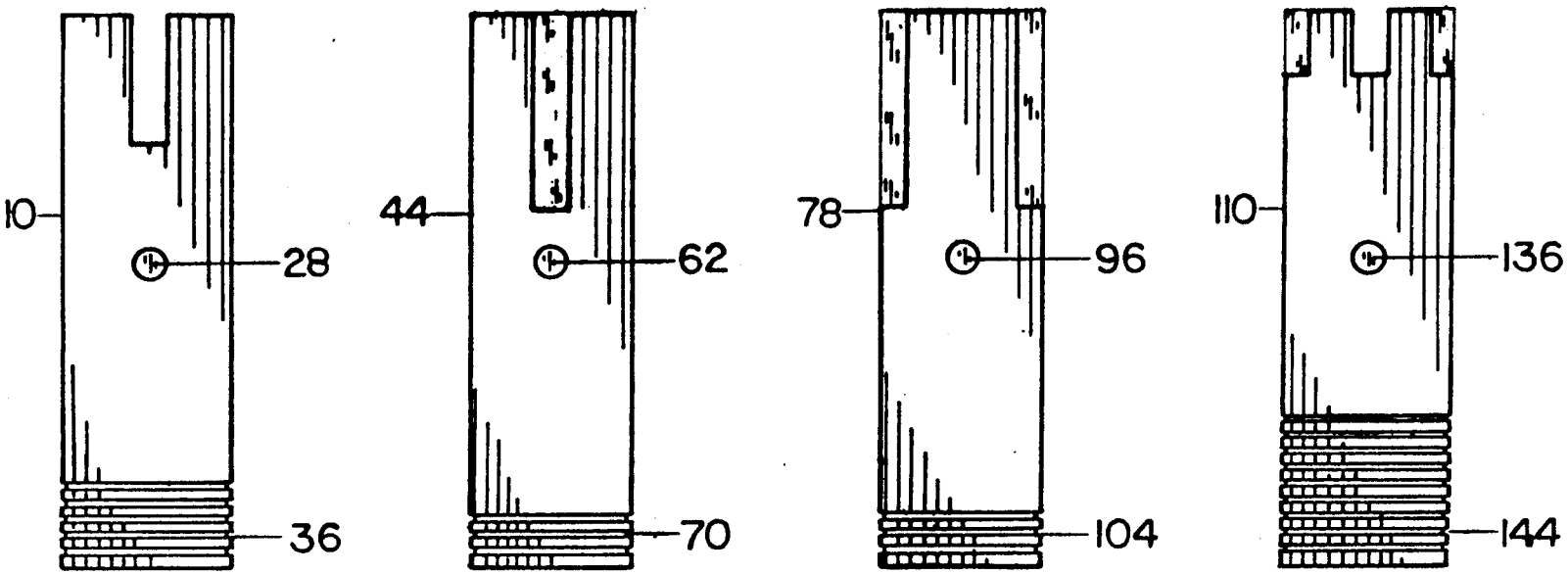
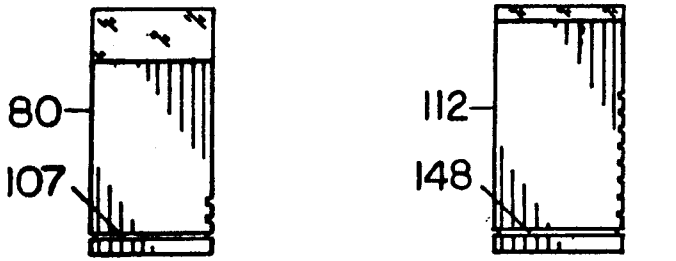
FIG. 5
FIG. 6
FIG. 7
FIG. 8

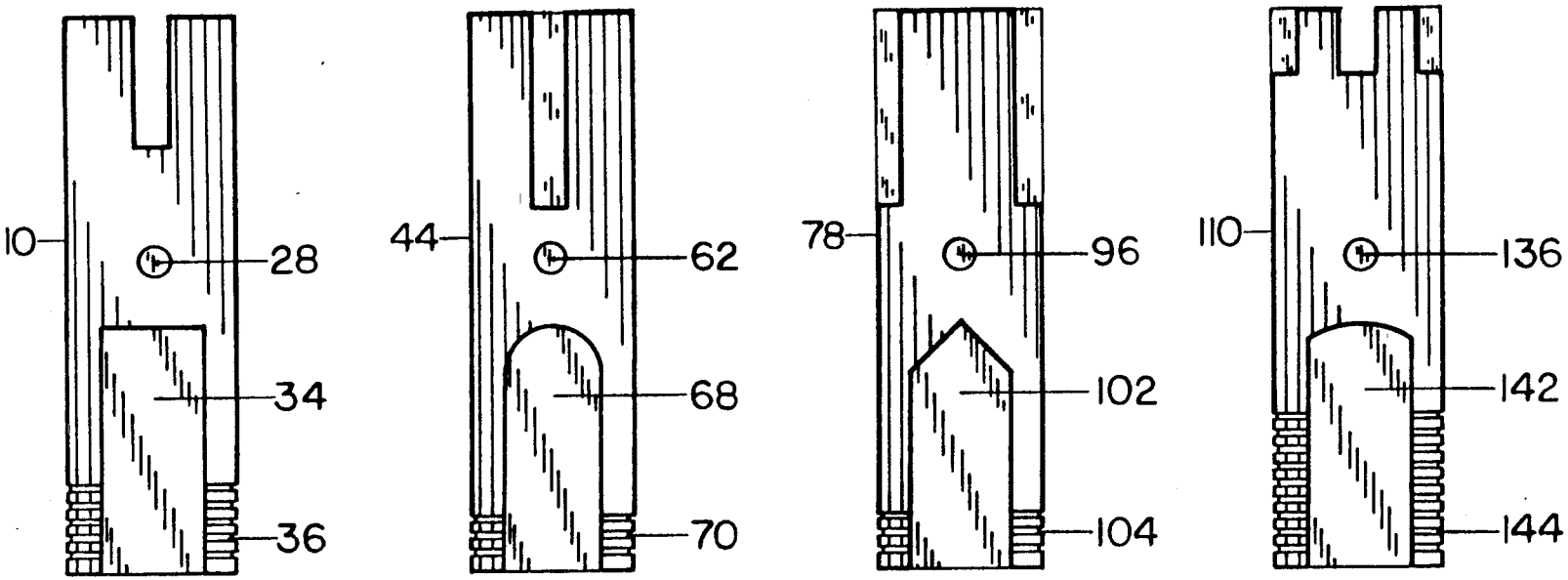
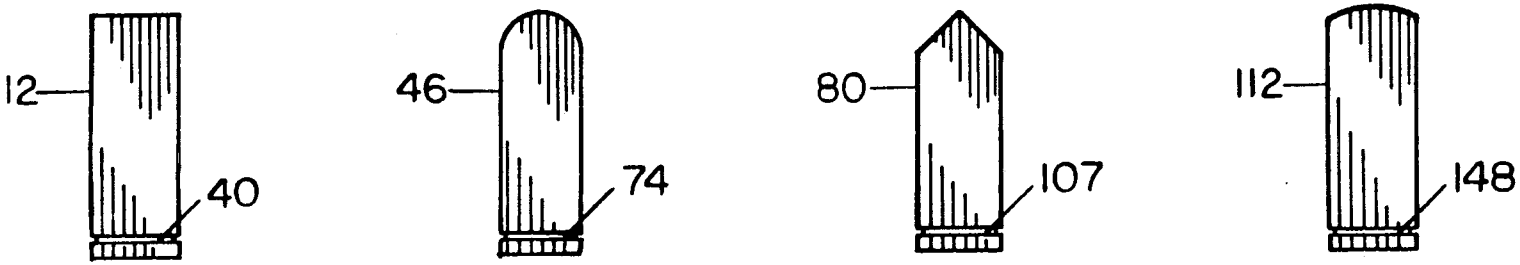
FIG. 9
FIG. 10
FIG. 11
FIG. 12

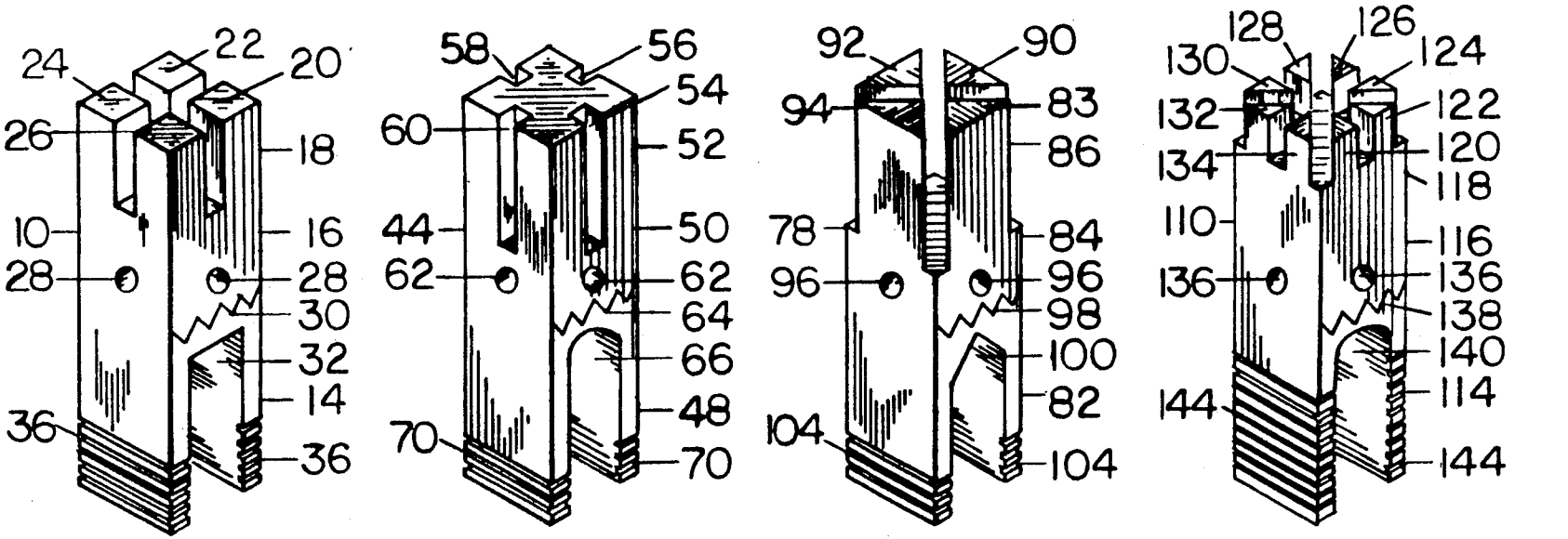
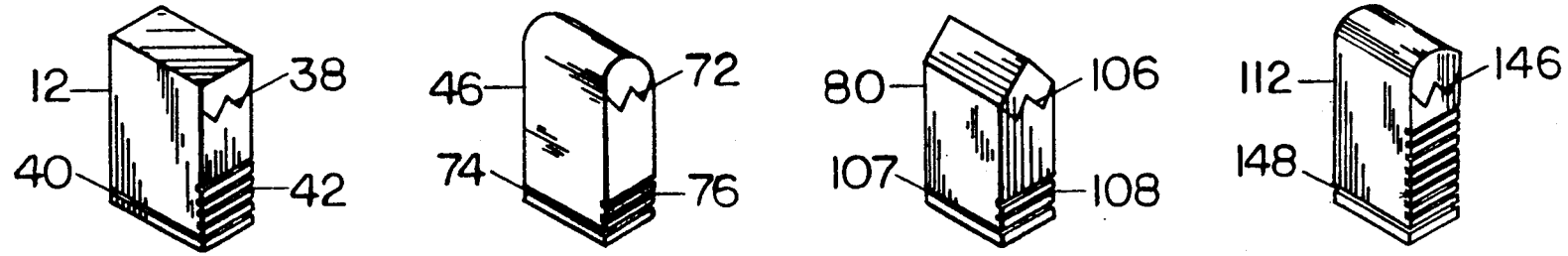
FIG. 13
FIG. 14
FIG. 15
FIG. 16

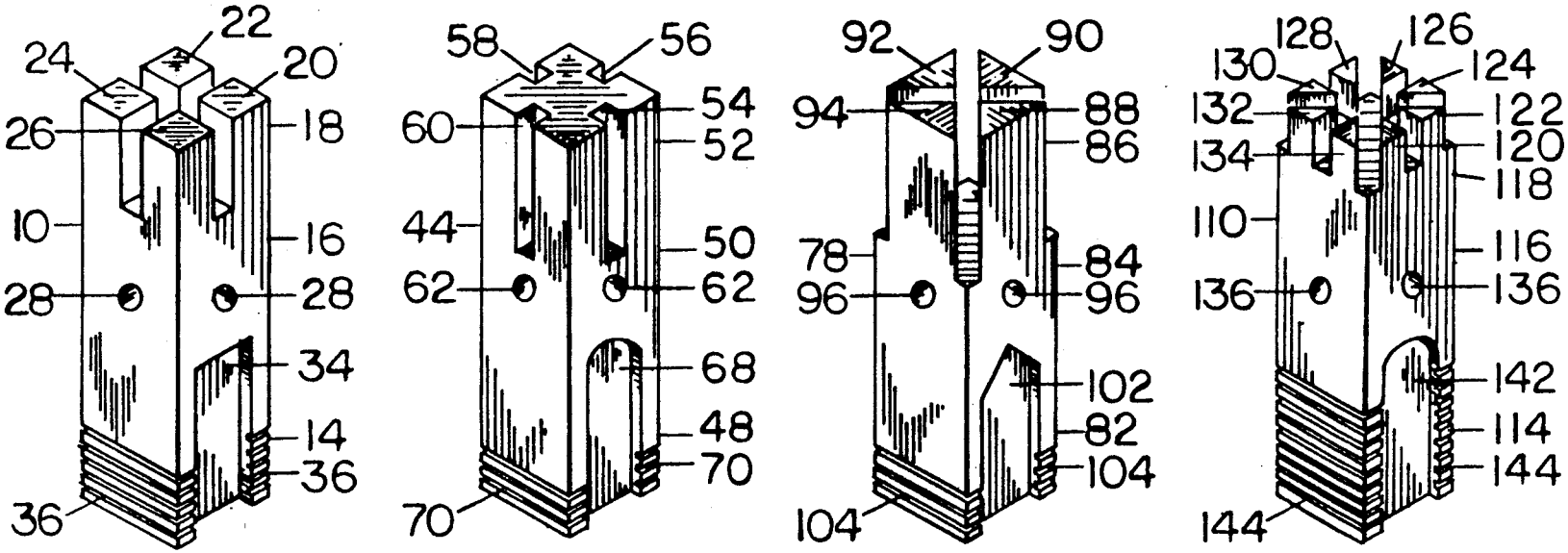
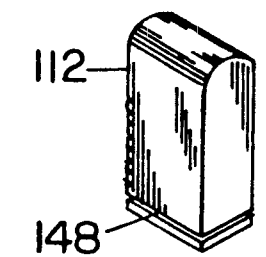
FIG. 17
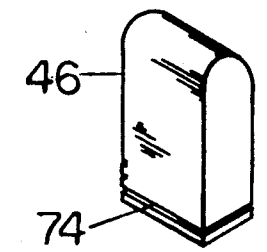
FIG. 18
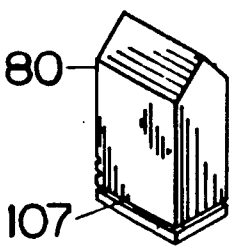
FIG. 19
FIG. 20

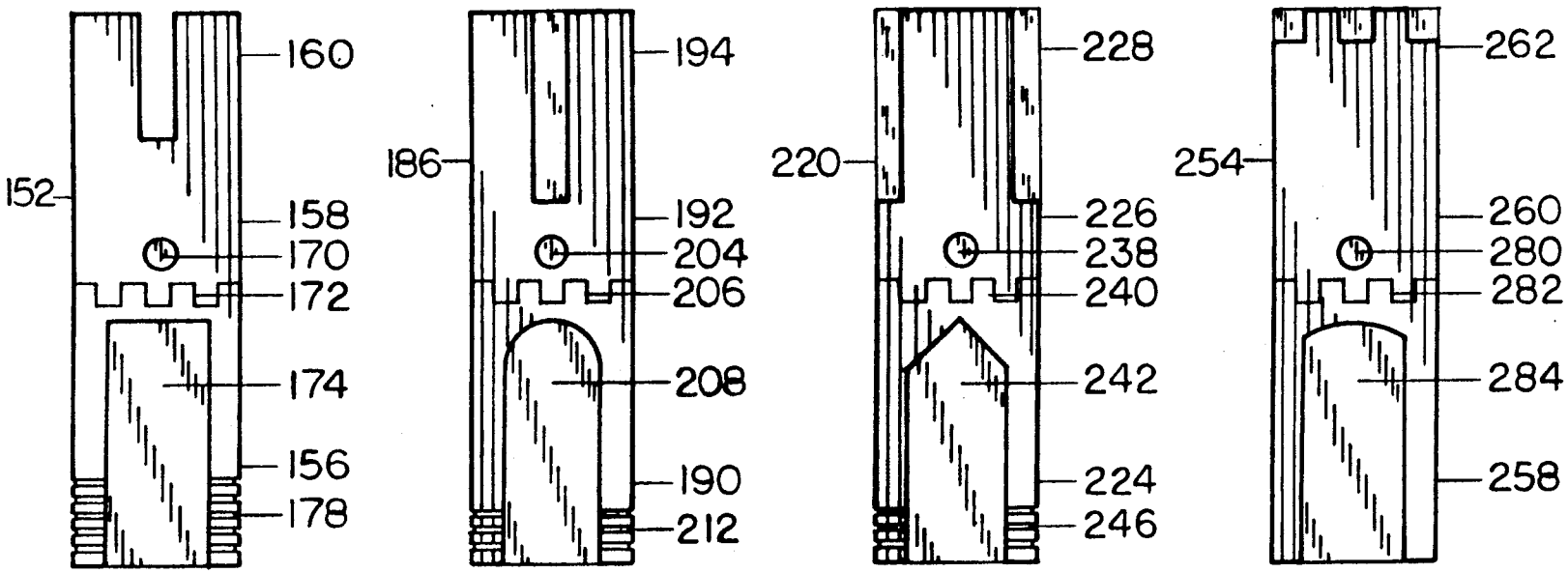
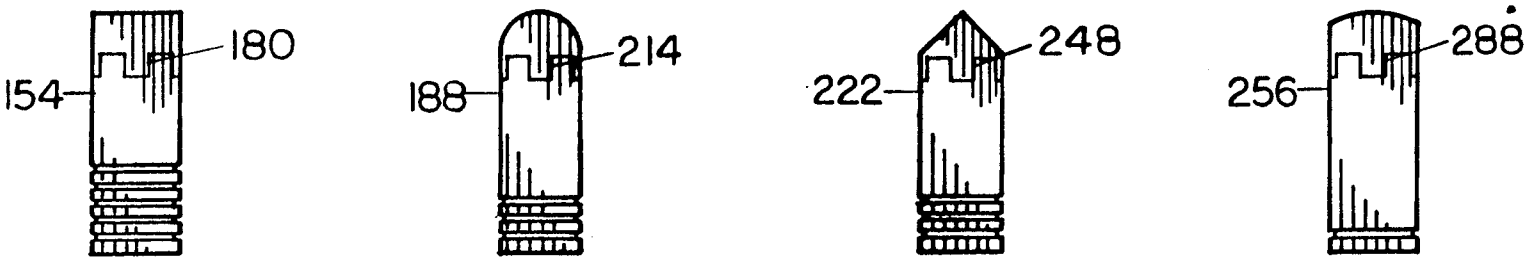
FIG. 21
FIG. 22
FIG. 23
FIG. 24

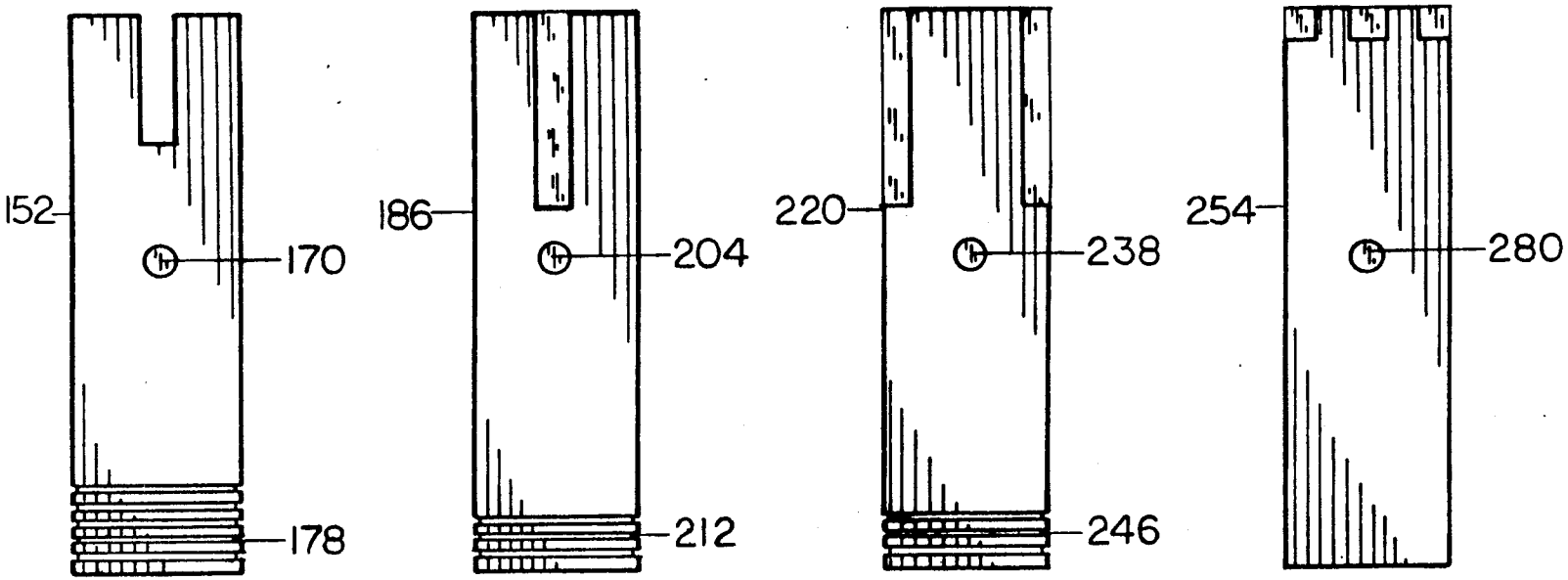
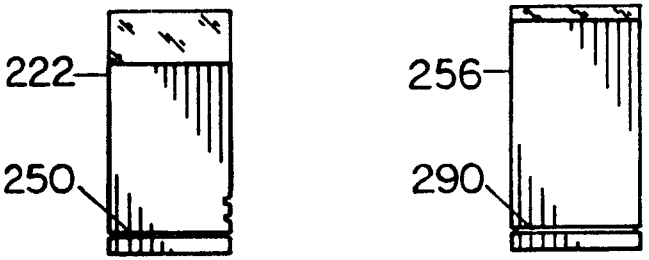
FIG. 25
FIG. 26
FIG. 27
FIG. 28

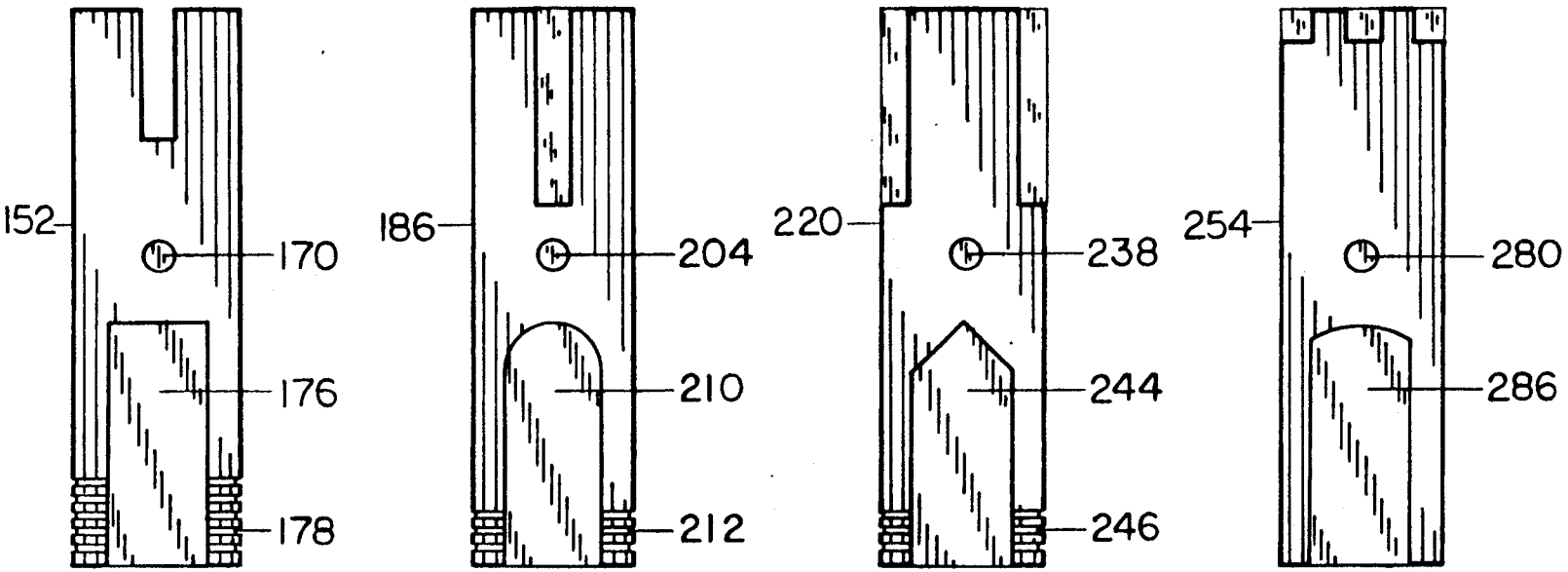
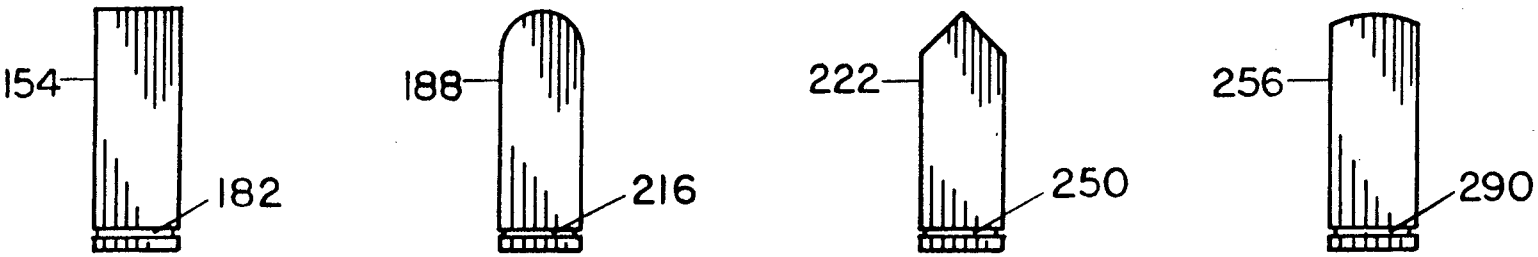
FIG. 29
FIG. 30
FIG. 31
FIG. 32

164
162
160
158
170
172
174
156
178
166
168
152
170
178
198
196
194
192
204
206
208
190
212
200
202
186
204
212
232
230
228
226
238
240
242
224
246
234
236
220
238
246
268
266
264
262
260
280
282
284
258
270
272
274
276
278
254
280
154
180
184
182
188
214
218
216
222
248
252
250
256
288
290

MODERN CHESS SET USING ARCHITECTURAL LANGUAGE TO SHAPE PLAYABLE PIECES

BACKGROUND OF THE INVENTION

This invention relates to board games, and more particularly to chess sets in which the pieces are sensitive to the touch and responsive to the move. This invention blends the functional symbolism inherent in the game with an abstract architectural language that makes each piece well-proportioned individually as well as part of the overall composition.

PRIOR ART

In the existing conventional chess set, the king and queen occupy the middle squares of the first row, with the queen on its own color. On each square next to the king and queen are the bishops; next to the bishops are the knights; and next to the knights are the rooks; while the pawns occupy the entire second row.

The king can move to any adjacent square not covered by a hostile piece. The queen can move to any square in any direction without jumping over pieces. The bishops can move diagonally to any square without jumping over pieces. The knight can move orthogonal in any direction in a fixed manner of two squares then one square to the right or left; the knight may jump over pieces. The rook can move orthogonal in any direction to any space without jumping over pieces. The pawns move to the square immediately in front but capture on the diagonal adjacent forward square, with the option of moving two squares straight ahead on their first move.

One aspect of how the pieces interact is "castling," which is a defensive move to insure the safety of the king and bring the rook into play. Castling consists of moving the king two squares toward the rook on the unobstructed rank, and transferring the rook to the square adjacent to the king on the other side. The qualifications required before castling are that the king must not have moved before, must not be in check, and must not pass over any square controlled by an enemy piece.

Another aspect of how the game is played, is that when a pawn reaches the last row, it becomes a queen.

The object of the game is to capture your opponent's king before he captures your king. If neither player captures a king, there is a stalemate, which ends the game in a draw.

SUMMARY OF THE INVENTION

This chess set is different from other chess sets in two ways. The first way is by tacking intangible aspects relating to how the game is played and translating them into the tangible shapes of each of the pieces.

This translation occurs at the tops of each of the pieces which are geometrically shaped to communicate the direction that each of the pieces can move when the game is played. This translation occurs also at the base of each piece as channel-like lines that extend around all four sides and collectively communicate the actual point value of each piece.

Another way that this chess set of the present invention is different from other chess sets is that the relationship between the pieces has changed in two ways. The first way is that a direct visual relationship has been established between each pawn and its "parent piece". The 'parent piece' refers to each one of the rooks, knights, bishops, queen or king that the pawn is placed in front of when the game is ready to begin.

This direct visual relationship is achieved by each pawn's parent piece having a cavity in the lower half of the piece open to the front whose shape is unique to it and having only one type of pawn that fits exactly inside its cavity. This visual relationship that is established between the pawn and its parent piece because of their shapes communicates a pawn as the rook's pawn, another pawn as the bishop's pawn throughout the entire course of the game.

During the course of a game, when a pawn reaches the last row, it becomes a duplication of its parent piece—with the exception of the king's pawn which can become any chess piece except another king.

The other way that the relationship between the pieces has changed is in a visual identification of the pieces on the queen's side of the board as the queen's and those on the king's side of the board as the king's. This visual identification of each side is accomplished by a crenulation. This crenulation is inscribed across the middle of the front elevation of the queen and the queen's bishop, knight, rook and their respective pawns and a different crenulation inscribed across the middle of the front elevation of the king and the king's bishop, knight, rook, and their respective pawns. These two different crenulations enables a player to distinguish the queen's pieces from the king's pieces throughout the entire game.

OBJECT OF THE INVENTION

It is an object of this invention to provide intangible aspects relating to how a chess game is played and translating these intangible aspects into tangible shapes of each of the playing pieces.

Another object of this invention is to provide a chess set which is different from other chess sets in that the relationships between the playable pieces is changed in two ways, namely a direct visual relationship between the shapes of some of the pieces, and the relationship established between the pieces through the crenulation.

DESCRIPTION OF PATENT DRAWINGS

These and other objects and advantages of this invention will become apparent from the following accompanying drawings and description herein.

FIG. 5 is a side elevation of a queen's rook and a pawn;

FIG. 6 is a side elevation of a queen's knight and a pawn;

FIG. 7 is a side elevation of a queen's bishop and a pawn;

FIG. 8 is a side elevation of a queen and a pawn;

FIG. 9 is a rear elevation of a queen's rook and a pawn;

FIG. 10 is a rear elevation of a queen's knight and a pawn;

FIG. 11 is a rear elevation of a queen's bishop and a pawn;

FIG. 12 is a rear elevation of a queen and a pawn;

FIG. 13 is a perspective view from the front of a queen's rook and a pawn;

FIG. 14 is a perspective view from the front of a queen's knight and a pawn;

FIG. 15 is a perspective view from the front of a queen's bishop and a pawn;

FIG. 16 is a perspective view from the front of a queen and a pawn;

FIG. 17 is a perspective view from the rear of a queen's rook and a pawn;

FIG. 18 is a perspective view from the rear of a queen's knight and a pawn;

FIG. 19 is a perspective view from the rear of a queen's bishop and a pawn,

FIG. 20 is a perspective view from the rear of a queen and a pawn;

FIG. 21 is a front elevation of a king's rook and a pawn;

FIG. 22 is a front elevation of a king's knight and a pawn;

FIG. 23 is a front elevation of a king's bishop and a pawn;

FIG. 24 is a front elevation of a king and a pawn;

FIG. 25 is a side elevation of a king's rook and a pawn;

FIG. 26 is a side elevation of a king's knight and a pawn;

FIG. 27 is a side elevation of a king's bishop and a pawn;

FIG. 28 is a side elevation of a king and a pawn;

FIG. 29 is a rear elevation of a king's rook and a pawn;

FIG. 30 is a rear elevation of a king's knight and a pawn;

FIG. 31 is a rear elevation of a king's bishop and a pawn;

FIG. 32 is a rear elevation of a king and a pawn;

SPECIFICATIONS AND EMBODIMENTS OF THE INVENTOR

Queen's Rook and Pawn

Figure 1:
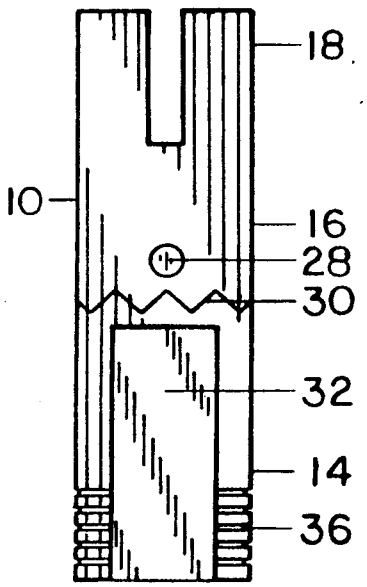
FIG. 1 is a front elevation of a queen's rook and a pawn.
Figure 1:
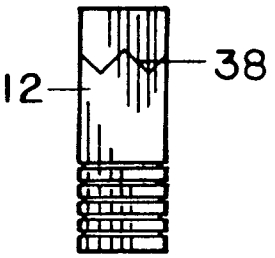
Figure 2:
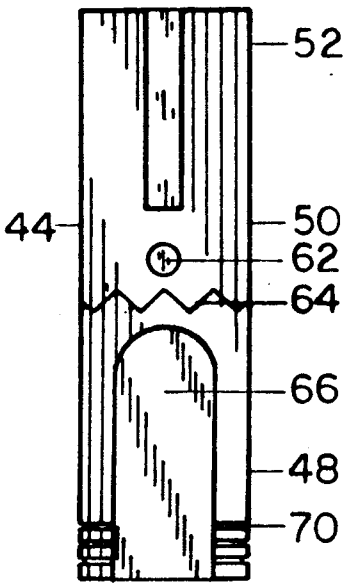
FIG. 2 is a front elevation of a queen's knight and a pawn.
Figure 2:
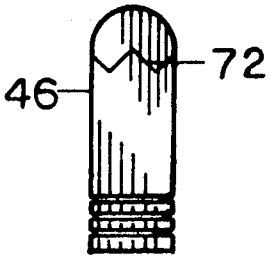
Figure 3:
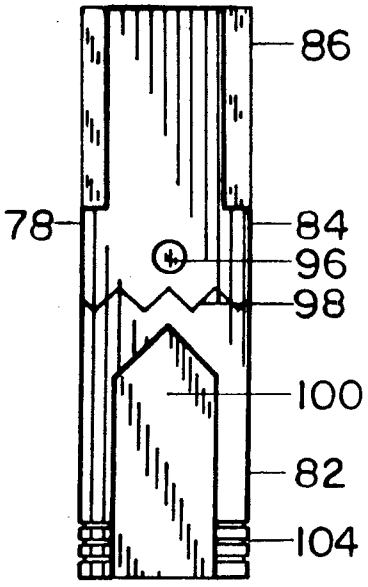
FIG. 3 is a front elevation of a queen's bishop and a pawn.
Figure 3:
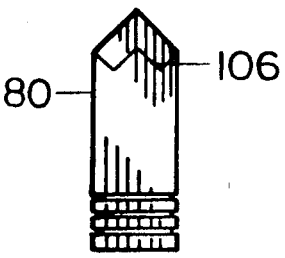
Figure 4:
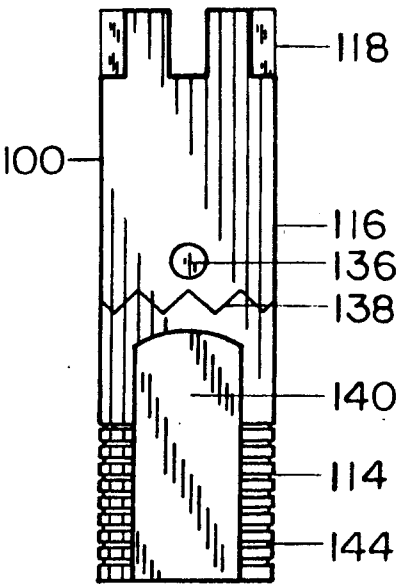
FIG. 4 is a front elevation of a queen and a pawn.
Figure 4:
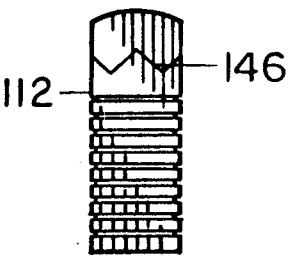
Figures 33, 34, 35, 36:
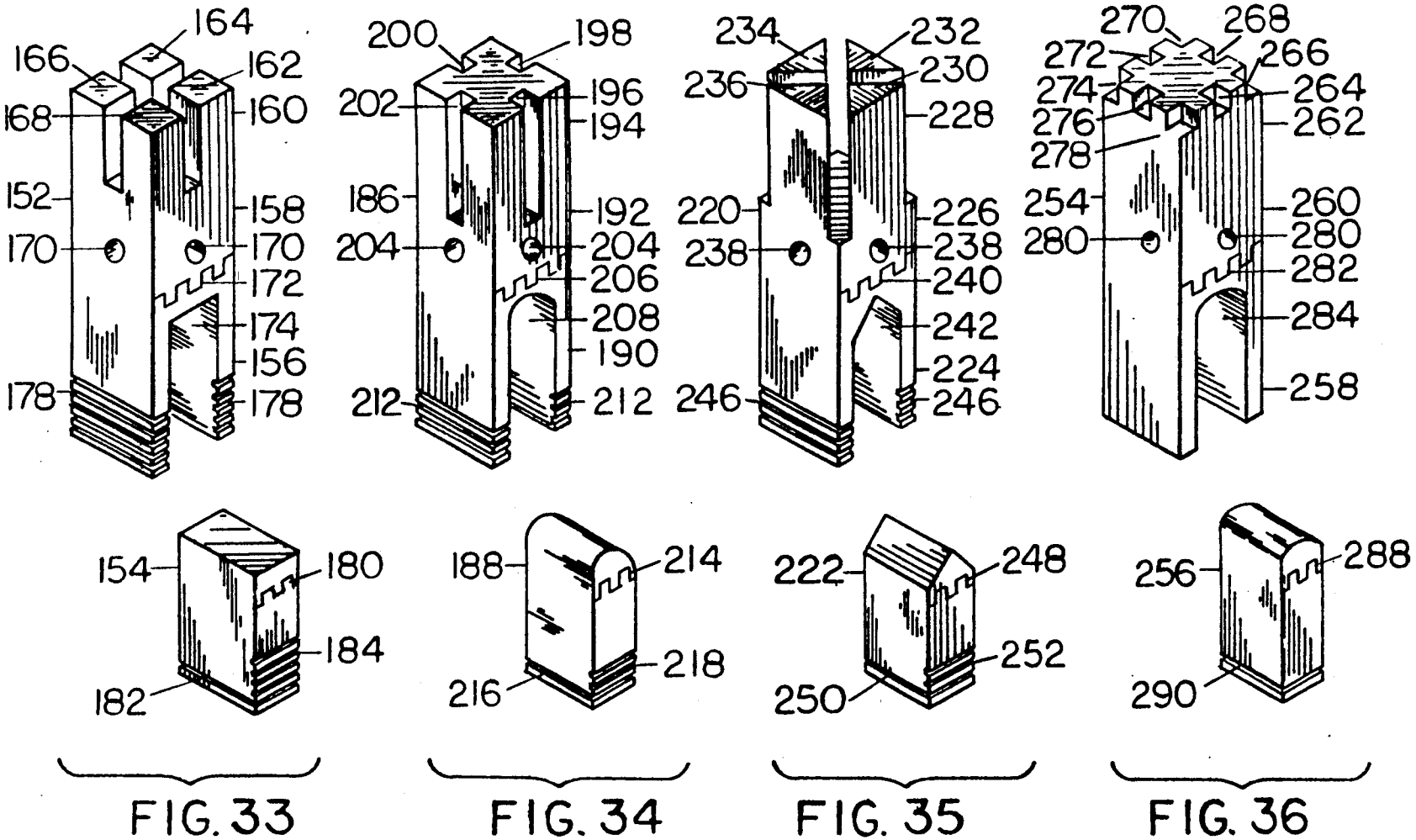
FIG. 33 is a perspective view from the front of a king's rook and a pawn.
FIG. 34 is a perspective view from the front of a king's knight and a pawn.
FIG. 35 is a perspective view from the front of a king's bishop and a pawn.
FIG. 36 is a perspective view from the front of a king and a pawn.
Figure 37:
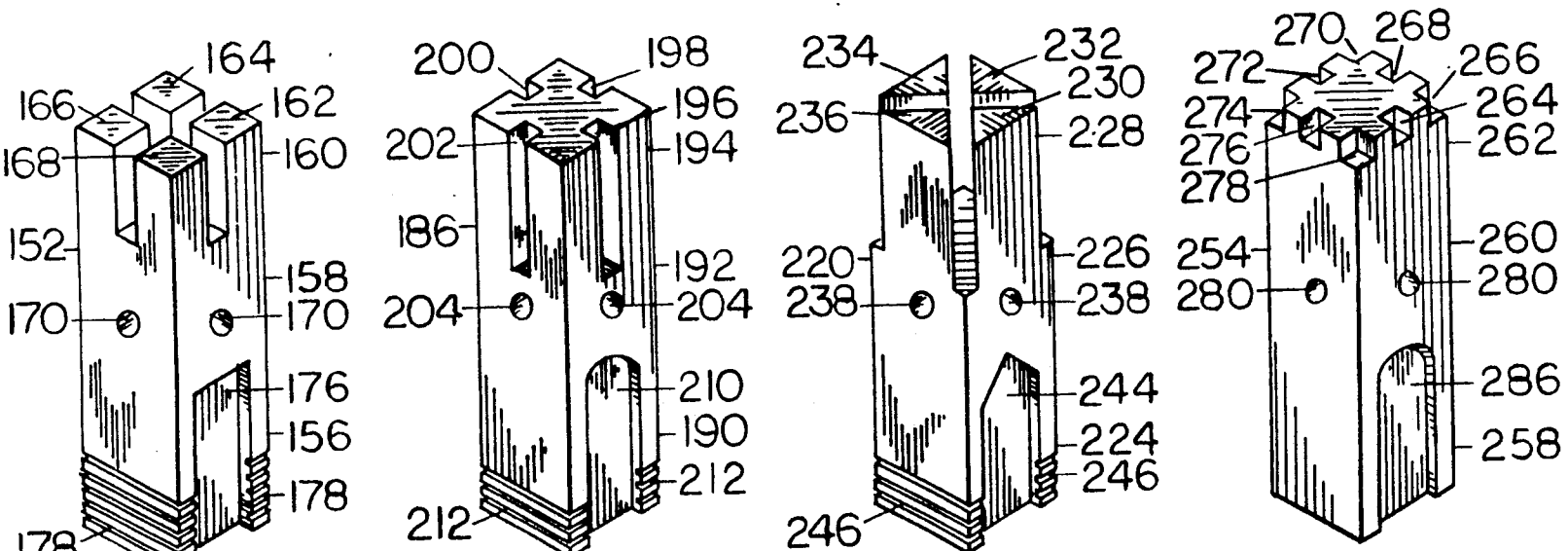
FIG. 37 is a perspective view from the rear of the king's rook and a pawn.
Figure 37:
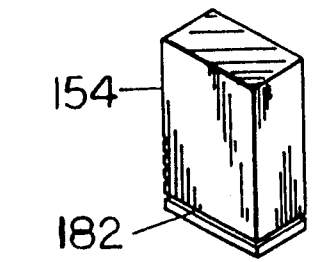
Figure 38:
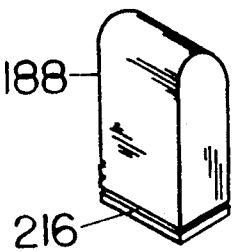
FIG. 38 is a perspective view from the rear of a king's knight and a pawn.
Figure 39:
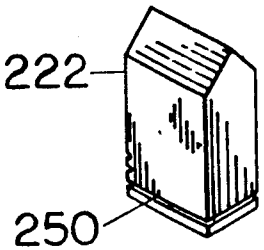
FIG. 39 is a perspective view from the rear of a king's bishop and a pawn.
Figure 40:
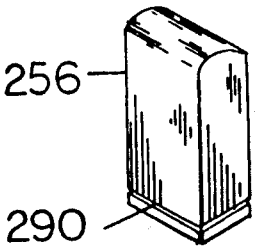
FIG. 40 is a perspective view from the rear of a king and a pawn.
Figure 41:
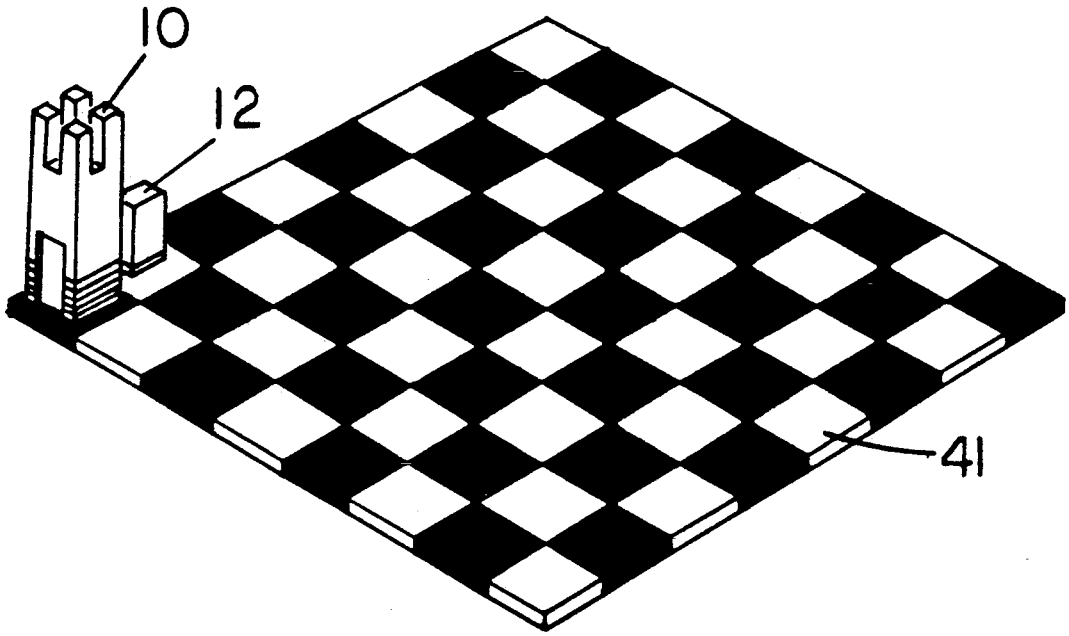
FIG. 41 is a perspective view showing a chess board with a queen's rook and a queen's rook pawn.

Referring now to FIGS. 1, 5, 9, 13, and 17, there is shown the queen's rook 10 and the queen's rook's pawn 12, positioned on a chess board FIG. 41. Other pieces would be located on the chess board FIG. 41 as normally expected when a game of chess is to be played. The rook is provided with a base 14, a middle 16, and a top 18. The top 18 is shaped into four separate but equal rectangular shapes 20, 22, 24, and 26 whose top faces are all squares and which collectively form a pair of intersecting slots that are 90 degrees to each other and orthogonal to the ranks and files of the chessboard when the rook is positioned for play. These slots indicate that the rook can move the full length of the board along the ranks or the files of the chessboard when it is engaged in play.

The rook's middle 16 consist of an ornamental aperture 28 on each elevation. Just below the aperture 28 on the front elevation only there is an inscription 30 which is a rectilinear zigzag scored at 45 degree angles. This inscription is the same marking as on the front elevation of the queen and visually identifies the rock as the queen's rook.

The lower part of base 14 is inscribed with horizontal channels 36 that extend around all sides and collectively communicate the point value of the queen's rook. On the front of the base is a longitudinally extending cavity 32 that extends to the inside of the back panel 34 seen best in FIG. 17. The shape of this cavity is unique to the rook 10 and the rook's pawn 12 whose form fits inside the cavity 32. This results in a unique relationship between them identifying the rook as the parent piece of the pawn.

The base of the rook's pawn 12 is inscribed with a horizontal channel 40 that extends around all sides and communicates the point value of the pawn. Just above the horizontal channel 40 on the front elevation only are ornamental channels 42 which align with the channels 36 at the rook's base 14 when the pawn 12 is placed into the cavity 32 of the rook. Just above ornamental channels 42 on the front elevation only there is an inscription 38 which visually identifies the pawn as the queen's rook's pawn. The longitudinal axis of the pawn in plan view indicates forward movement when the piece is positioned for play.

Queen's Knight and Pawn

One space to the right of the queen's rook 10 and the pawn 12 there is shown in FIGS. 2, 6, 10, 14, and 18 the queen's knight 44 and the queen's knight pawn 46. The knight 44 is provided with a base 48, a middle 50, and a top 52. The top 52 is shaped with four separate but equal vertically rectangular notches 54, 56, 58, and 60. There is a notch at the midpoint of the top of each elevation indicating that the knight can move in the direction that the notch faces in a fixed manner as described in the game rules when it is engaged in play.

The knight's middle 50 consist of an ornamental aperture 62 on each elevation. Just below the aperture 62 on the front elevation only there is an inscription 64 which is a rectilinear zigzag scored at 45 degree angles. This inscription is the same marking as on the front elevation of the queen and visually identifies the knight as the queen's knight.

The lower part of the base 48 is inscribed with horizontal channels 70 that extend around all sides and collectively communicate the point value of the queen's knight 44. On the front of the base is a longitudinally extending rectangular cavity 66 with a semiconductor convex top that extends to the inside of the back panel 68 seen best in FIG. 18. The shape of the cavity is unique to the knight 44 and the knight's pawn 46 whose form fits inside the cavity 66. This results in a unique identifiable relationship between them identifying the knight as the parent piece of the pawn.

The base of the knight's pawn 46 is inscribed with a horizontal channel 74 that extends around all sides and communicates the point value of the pawn. Just above the horizontal channel 74 on the front elevation only are ornamental channels 76 which align with the channels 70 at the knight's base 48 when the pawn 46 is place into the cavity 66 of the knight. Just above the ornamental channels 76 on the front elevation only there is an inscription 72 which visually identifies the pawn as the queen's knight's pawn. The longitudinal axis of the pawn in plan view indicates forward movement when the piece is positioned for play.

Queen Bishop and Pawn

One space to the right of the queen's knight 44 and pawn 46 there is shown in FIGS. 3, 7, 11, 15, and 19 the queen's bishop 78 and the queen's bishop's pawn 80. The bishop 78 has a base 82, a middle 84, and a top 86. The top 86 is shaped into four separate but equal triangular prisms 88, 90, 92, and 94 whose top faces are all right triangles and which collectively form a pair of intersecting slots that are 90 degrees to each other and diagonal to the ranks and files of the chess board when the bishop is positioned for play. This pair of slots indicate that the bishop can move the full length of the board along the diagonal between the ranks and the files of the chessboard when it is engaged in play.

The bishop's middle 84 consist of an ornamental aperture 96 on each elevation. Just below the aperture 96 on the front elevation only there is an inscription 98 which is a rectilinear zigzag scored at 45 degree angles. This inscription is the same marking as on the front elevation of the queen and visually identifies the bishop as the queen's bishop.

The lower part of the base 82 is inscribed with horizontal channels 104 that extend around all sides and collectively communicate the point value of the queen's bishop 78. On the front of the base 82 is a longitudinally extending rectangular cavity 100 with a 45 degree pitched top that extends to the inside of the back panel 102 seen best in FIG. 19. The shape of the cavity is unique to the bishop 78 and the bishop's pawn 80 whose form fits inside the cavity 100. This results in a visually unique relationship between them identifying the bishop as the parent piece of the pawn.

The base of the bishop's pawn 80 is inscribed with a horizontal channel 107 that extends around all sides and communicates the point value of the pawn. Just above the horizontal channels 104 at the bishop's base 82 when the pawn 80 is placed into the cavity 100 of the bishop. Just above the ornamental channels 104 on the front elevation only there is an inscription 106 which visually identifies the pawn as the queen's bishop's pawn. The longitudinal axis of the pawn in plan view indicates forward movement when the piece is positioned for play.

Queen and Queen's Pawn

One space to the right of the queen's bishop 78 and pawn 80 there is shown in FIGS. 4, 8, 12, 16, and 20 a queen 110 and the queen's pawn 112. The queen 110 is provided with a base 114, a middle 116, and a top 118. The top 118 is shaped into eight separate but equal triangular prisms 120, 122, 124, 126, 128, 130, 132, and 134 whose top faces are all isosceles right triangles. These prisms collectively form two pair of intersecting slots. The first pair of slots are 90 degrees to each other and orthogonal to the ranks and files of the chess board and the second pair of intersection slots are 90 degrees to each other and diagonal to the ranks and files of the chessboard. Both pair of slots collectively indicate that the queen can move the full length of the board along the ranks or the files or the diagonals to both of them when it is engaged in play.

The queen's middle 116 consist of an ornamental aperture 136 on each elevation. Just below the aperture 136, on the front elevation only, there is an inscription 138 which is a rectilinear zigzag scored at 45 degree angles. This inscription serves to visually identify the queen with the pieces on her side of the board.

The lower part of the base 114 is inscribed with horizontal channels 144 that extend around all sides and collectively communicate the point value of the queen. On the front of the base is a longitudinally extending rectangular cavity 140 with an elliptical convex top that extends to the inside of the back panel 142 seen best in FIG. 20. The shape of this cavity is unique to the queen 110 and the queen's pawn 112 whose form fits inside the cavity 140 of the queen. This results in a unique identifiable relationship between them identifying the queen as the parent piece of the pawn.

The base of the pawn 112 is inscribed with a horizontal channel 148 that extends around all sides and communicates the point value of the pawn. Just above the horizontal channel 148 on the front elevation only are ornamental channels 150 which align with the channels 144 at the queen's base 114 when the pawn 112 is placed into the cavity 140. Just above the ornamental channels 150 on the front elevation only there is an inscription 146 which visually identifies the pawn 112 as the queen's pawn. The longitudinal axis of the pawn in plan view indicates forward movement when the piece is positioned for play.

King's Rook and Pawn

Referring now to FIGS. 21, 25, 29, 33, 37, there is shown the king's rook 152 and the king's rook's pawn 154. The rook is provided with a base 156, a middle 158, and a top 160. The top 160 is articulated into four separate but equal rectangular shapes 162, 164, 166, and 168 whose top faces are all squares and which collectively form a pair of interesting slots that are 90 degrees to each other and orthagonal to the ranks and files of the chessboard when the rook is positioned for play. These slots indicate that the rook can move the full length of the board along the ranks or the files of the chessboard when it is engaged in play.

The rook's middle 158 consist of an ornamental aperture 170 on each elevation. Just below the aperture 170 on the front elevation only there is an inscription 172 which is a rectilinear zigzag scored at 90 degree angles. This inscription is the same marking as on the front elevation of the king and visually identifies the rook as the king's rook.

The lower part of base 156 is inscribed with horizontal channels 178 that extend around all sides and collectively communicate the point value of the king's rook. On the front of the base is a longitudinally extending cavity 174 that extends to the inside of the back panel 176 seen best in FIG. 37. The shape of this cavity is unique to the rook and the rook's pawn whose form fits inside the cavity 74 of the rook. This results in a unique relationship between them identifying the rook as the parent piece of the pawn.

The base of the rook's pawn 154 is inscribed with a horizontal channel 182 that extends around all sides and communicates the point value of the pawn. Just above the horizontal channel 182 on the front elevation only are ornamental channels 184 which align with the channels 178 at the rook's base 156 when the pawn 154 is placed into the cavity 174 of the rook. Just above the ornamental channels 184 on the front elevation only there is an inscription 180 which identifies the pawn as the king's rook's pawn. The longitudinal axis of the pawn in plan view indicates forward movement when the piece is positioned for play.

King's Knight and Pawn

One space to the left of the king's rook 152 and the pawn 154 there is shown in FIGS. 22, 26, 30, 34, 38 the king's knight 186 and the king's pawn 188. The knight 186 has a base 190, a middle 192, and a top 194. The top 194 is shaped with four separate but equal vertically rectangular notches 196, 198, 200, and 202. There is a notch at the midpoint of the top of each elevation indicating that the knight can move in the direction that the notch faces in a fixed manner as described in the game rules when it is engaged in play.

The knight's middle 192 consist of an ornamental aperture 204 on each elevation. Just below the aperture 204 on the front elevation only there is an inscription 206 which is a rectilinear zigzag scored at 90 degree angles. This inscription is the same marking as on the front elevation of the king and visually identifies the knight as the king's knight.

The lower part of base 190 is inscribed with horizontal channels 212 that extend around all sides and collectively communicate the point value of the king's knight. On the front of the base 224 is a longitudinally extending rectangular cavity 208 with a semicircular convex top that extends to the inside of the back panel 210 seen best in FIG. 38. The shape of the cavity is unique to the knight and the knight's pawn whose form fits inside the cavity 208 of the knight. This results in a visually unique relationship between them identifying the knight as the parent piece of the pawn.

The base of the pawn 188 is inscribed with a horizontal channel 216 that extends around all sides and communicates the point value of the pawn. Just above the horizontal channel 216 on the front elevation only are ornamental channels 218 which align with the channels 212 of the knight when the pawn is placed into the cavity 208. Just above the ornamental channels 218 on the front elevation only there is an inscription 214 which visually identifies the pawn as the king's knight's pawn. The longitudinal axis of the pawn in plan view indicates forward movement when the piece is positioned for play.

King's Bishop and Pawn

One space to the left of the king's knight 186 and pawn 188 there is shown in FIGS. 23, 27, 31, 35, and 39 the king's bishop 220 and the king's bishop's pawn 222. The bishop 220 has a base 224, and middle 226 and a top 228. The top 228 is shaped into four separate but equal triangular prisms 230, 232, 234, and 236 whose top faces are all right triangles and which collectively form a pair of intersecting slots that are 90 degrees to each other and diagonal to the ranks and files of the chess board when the bishop is positioned for play. This pair of slots indicate that the bishop can move the full length of the board along the diagonal between the ranks and the files of the chess board when it is engaged in play.

The bishop's middle 226 consist of an ornamental aperture 238 on each elevation. Just below the aperture 238 on the front elevation only there is an inscription 240 which is a rectilinear zigzag scored at 90 degree angles. This inscription is the same marking as on the front elevation of the king and visually identifies the bishop as the king's bishop.

The lower part of the base 224 is inscribed with horizontal channels 246 that extend around all sides and collectively communicate the point value of the king's bishop 220. On the front of the base 224 is a longitudinally extending rectangular cavity 242 with a 45 degree pitched top that extends to the inside of the back panel 224 seen best in FIG. 39. The shape of the cavity is unique to the bishop 220 and the bishop's pawn 222 whose form fits inside the cavity of the bishop. This results in a visually unique relationship between them identifying the bishop as the parent piece of the pawn.

The base of the pawn 222 is inscribed with a horizontal channel 250 that extends around all sides and communicates the point value of the pawn. Just above the horizontal channel 250 on the front elevation only are ornamental channels 252 which along with the channels 246 of the king's bishop 220 when the pawn 222 is placed into the cavity 242 of the bishop. Just above the ornamental channels 252 on the front elevation only there is an inscription 248 which visually identifies the pawn as the king's bishop's pawn. The longitudinal axis of the pawn in plan view indicates forward movement when the piece is positioned for play.

King and King's Pawn

One space to the left of the king's bishop 220 and pawn 222 there is shown in FIGS. 24, 28, 32, 26, and 40 a king 254 and a king's pawn 256. The king 254 is provided with a base 258, a middle 260, and a top 262. The top 262 is shaped into eight separate but equal rectangular notches 264, 266, 268, 270, 272, 274, 276, and 278. These notches collectively indicate that the king can move along the ranks, the files, or diagonally between them in a fixed manner as described in the game rules when it is engaged in play.

The king's middle 260 consist of an ornamental aperture 280 on each elevation. Just below the aperture 280, on the front elevation only, there is an inscription 282 which is a rectilinear zigzag scored at 90 degree angles. This inscription serves to visually identify the king with the pieces on his side of the board.

On the front of the base 258 is a longitudinally extending rectangular cavity 284 with an elliptical convex top. This cavity 284 extends to the inside of the back panel 286 seen best in FIG. 40. The shape of the cavity is unique to the king and the king's pawn whose form fits inside the cavity 284. This results in a unique relationship between them identifying the king as the parent piece of the pawn.

The base of the pawn 256 is inscribed with a horizontal channel 290 that extends around all sides and communicates the point value of the pawn. Just above the horizontal channel 290 on the front elevation only is an inscription 288 which visually identifies the pawn as the king's pawn. The longitudinal axis of the pawn in plan view indicates forward movement when the piece is positioned for play.

Accordingly, modifications and variations to which the invention is susceptible may be practiced without departing from the scope and intent of the appended claims.

What is claimed is:

1. A chess set, comprising, a dimensional chess board, a plurality of playable chess pieces and pawns positioned for play on said dimensional chess board, with each said playable chess piece and pawn having a structure comprising channel-like lines extending around all sides of each chess piece and pawn which indicate the point value of each said playable chess piece and pawn, a geometrical band inscribed on the front of each said playable chess piece and pawn for identifying groups of playable pieces which have matching bands, said playable chess pieces and pawns having tops which are geometrically shaped to symbolically indicate the direction that each said playable chess piece and pawn can move when it is engaged in play.

2. A chess set, as recited in claim 1, wherein said chess pieces are provided with a cavity whose shape is unique to each chess piece, and an individual pawn whose particular shape fits exactly inside the cavity of its respective chess piece, whereby a unique relationship is established between said pawn and said chess piece identifying the chess piece as the parent piece of the pawn.

3. A chess set as recited in claim 2, wherein when a selected pawn reaches the eighth rank it becomes a copy of its parent piece with the exception of the king's pawn which can be a copy of any chess piece except the king.

4. A chess set, as recited in claim 1, wherein said playable chess pieces and pawns have geometrically shaped tops that symbolically indicate the direction that the chess pieces and the pawns can move when they are engaged in play, with the shape of the tops of the chess pieces being defined as either a collection of slots or a collection of notches and the top plan view of each pawn having both a longitudinal and a lateral axis.

5. A conventional chess set, as recited in claim 4, wherein at least some of the chess pieces are provided with slots on their tops which indicate movement the full length of said chess board along the ranks, the files, or diagonally to both of them in the direction the slot faces when said chess pieces are engaged in play.

6. A chess set, as recited in claim 4, wherein at least some of the chess pieces are provided with notches on their tops which indicate limited mobility along the ranks, the files, or diagonally to both of them in the direction the notch faces when said chess pieces are engaged in play.

7. A chess set, as recited in claim 4, wherein the top plan view of each pawn has a longitudinal axis that indicates forward movement when a pawn is engaged in play.

8. A chess set, as recited in claim 1, wherein said playable chess pieces and pawns have geometric inscriptions on the front of each chess piece and pawn, said inscriptions visually identify groups of playable pieces that exhibit matching inscriptions.

9. A chess set, as recited in claim 8, wherein at least some of said playable chess pieces and pawns are provided with matching geometric inscriptions which identify the king with the king's side of the chessboard, said inscriptions being a rectilinear zigzag scored at 90 degree angles creating a notched band exhibited across the front of said chess pieces and their respective pawns.

10. A chess set, as recited in claim 8, wherein at least some of said playable chess pieces and pawns having matching geometric inscriptions that identify the queen with the queen's side of the chessboard, said inscriptions begin a rectilinear zigzag scored at 45 degree angles creating a saw tooth band exhibited across the front of said chess pieces and their respective pawns.

11. A chess set, as recited in claim 1, wherein said playable chess pieces and pawns are provided with having channel like lines, said lines extending around all sides are scored in each chess piece with their respective pawn and collectively identify the point value of each playable piece.

* * * * *